US005557958A

United States Patent [19]

Nishida et al.

[11] Patent Number: 5,557,958

[45] Date of Patent: Sep. 24, 1996

[54] DYNAMIC BALANCER CIRCUIT OF TRANSFER FEEDER

[75] Inventors: Kenji Nishida; Kazuhiko Shiroza, both of Komatsu, Japan

[73] Assignee: Kabushiki Kaisha Komatsu Seisakusho, Tokyo, Japan

[21] Appl. No.: 331,479

[22] PCT Filed: Apr. 30, 1993

[86] PCT No.: PCT/JP93/00591

§ 371 Date: Oct. 28, 1994

§ 102(e) Date: Oct. 28, 1994

[87] PCT Pub. No.: WO93/22080

PCT Pub. Date: Nov. 11, 1993

[30] Foreign Application Priority Data

May 7, 1992 [JP] Japan ..... 4-114826

[51] Int. Cl.[6] ..... B21D 43/05

[52] U.S. Cl. ..... 72/20.1; 72/405.11; 72/451; 74/569

[58] Field of Search ..... 72/405, 21, 20.1, 72/451, 405.11–405.13; 74/569, 53

[56] References Cited

U.S. PATENT DOCUMENTS

| | | | |
|---|---|---|---|
| 3,413,862 | 12/1968 | Waara | 74/53 |
| 3,875,808 | 4/1975 | Okamoto | 72/405 |
| 4,436,199 | 3/1984 | Baba | 72/405 |
| 4,655,097 | 4/1987 | Suzuki | 74/53 |

FOREIGN PATENT DOCUMENTS

| | | | |
|---|---|---|---|
| 57-66889 | 4/1982 | Japan . | |
| 237030 | 9/1989 | Japan | 72/405 |
| 2-28330 | 2/1990 | Japan . | |
| 70332 | 3/1990 | Japan | 72/405 |
| 2-17254 | 4/1990 | Japan . | |

*Primary Examiner*—Daniel C. Crane

*Attorney, Agent, or Firm*—Frishauf, Holtz, Goodman, Langer & Chick

[57] ABSTRACT

In a transfer feeder in which transfer bars are driven in a feeding direction by swinging a feed lever (4) through a cam-follower (5) by a feed cam (2) mounted to a camshaft (1) rotated by power taken out of a transfer press, a control circuit controls air pressure of a rear cushion cylinder (6) pushing the feed lever to the feed cam to an optimum value in response to a production speed of the press.

15 Claims, 3 Drawing Sheets

DYNAMIC BALANCER CIRCUIT OF TRANSFER FEEDER

This application is a 371 of PCT/JP93/00591, filed Apr. 30, 1993.

TECHNICAL FIELD

The present invention relates to a dynamic balancer circuit of a transfer feeder.

BACKGROUND ART

A transfer feeder equipped for a conventional transfer press is provided with a pair of transfer bars in a feeding direction, and a work is carried in and out to and from a press by the transfer bars, through the operation thereof in a two-dimensional or three-dimensional direction in synchronism of the transfer bars with the press, to thereby carry out the conveyance between respective working stations.

The transfer feeder is also provided with a driving mechanism for driving the transfer bars in the two or three dimensional direction, and a camshaft driven by power taken out of the press is provided for the driving mechanism. To the camshaft are mounted a feed cam and a lift cam by which a feed lever and a lift lever are swung through cam followers, respectively, whereby the transfer bars are driven in the two-dimensional direction or three-dimensional direction.

In the conventional transfer feeder of the structure described above, a rear cushion cylinder composed of an air cylinder is utilized for pushing the cam follower of the feed lever to the feed cam, and an air pressure to be supplied to the rear cushion cylinder is set to the maximum value necessary in consideration of the condition that a weight of a movable member is generally subjected to the maximally accelerated speed at the maximum production speed (maximum operation speed) of the press.

For the reason described above, in the described conventional transfer feeder, a pushing force at the maximum production speed is applied to the feed cam through the cam follower even in a case where the production speed (operation speed) of the press does not reach the maximum production speed, resulting in an early reduction of the lifetime of the driving system of the transfer feeder and an increase of power consumption, thus being inconvenient.

Therefore, an object of the present invention is to provide a dynamic balancer circuit of a transfer feeder capable of controlling a pushing force of a rear cushion cylinder to an optimum value in response to a production speed of a press to thereby improve the lifetime of a driving system and to reduce the power consumption.

DISCLOSURE OF THE INVENTION

In order to achieve the above and other objects, according to a first structure of the present invention, there is provided a dynamic balancer circuit of a transfer feeder in which transfer bars are driven in a feeding direction by swinging a feed lever by a feed cam mounted to a camshaft rotated by power taken out of a transfer press, wherein a control circuit is provided for controlling an air pressure of a rear cushion cylinder pushing the feed lever to the feed cam through a cam follower to an optimum value in response to a production speed of a press.

According to this structure, since the pushing force of the rear cushion cylinder does not exceed a necessary value, the lifetime of the driving system can be improved and power consumption can be reduced.

Further, it will be desired that the optimum value accords with the minimum value that is necessary.

According to a second aspect of the present invention, there is provided, in addition to the above first structure, a dynamic balancer circuit of a transfer feeder wherein the aforementioned control circuit at least comprises a press speed detection sensor, an electromagnetic valve unit disposed between an air supply source and the rear cushion cylinder, and a sequencer for controlling the electromagnetic valve unit in response to the production speed of the press detected by the press speed detection sensor on the basis of a program preliminarily set in accordance with a kind of a work.

According to a third aspect of the present invention, there is provided, in addition to the above second structure, a dynamic balancer circuit of a transfer feeder, wherein the aforementioned control circuit is provided with an air pressure detection sensor for detecting an air pressure to the rear cushion cylinder and the detected air pressure value is fed back to the sequencer.

BRIEF DESCRIPTION OF THE DRAWINGS

The present invention will be more clearly understood from the following detailed description and accompanying drawings representing an embodiment of the present invention. Further, the embodiment shown in the accompanying drawings does not intend to specify the invention and merely intends to make easy the explanation and understanding of the present invention.

In the accompanying drawings.

BEST MODE FOR EMBODYING THE INVENTION

Hereunder, a dynamic balancer circuit of a transfer feeder according to a preferred embodiment of the present invention will be described with reference to FIGS. 1 to 3.

Figure 1:
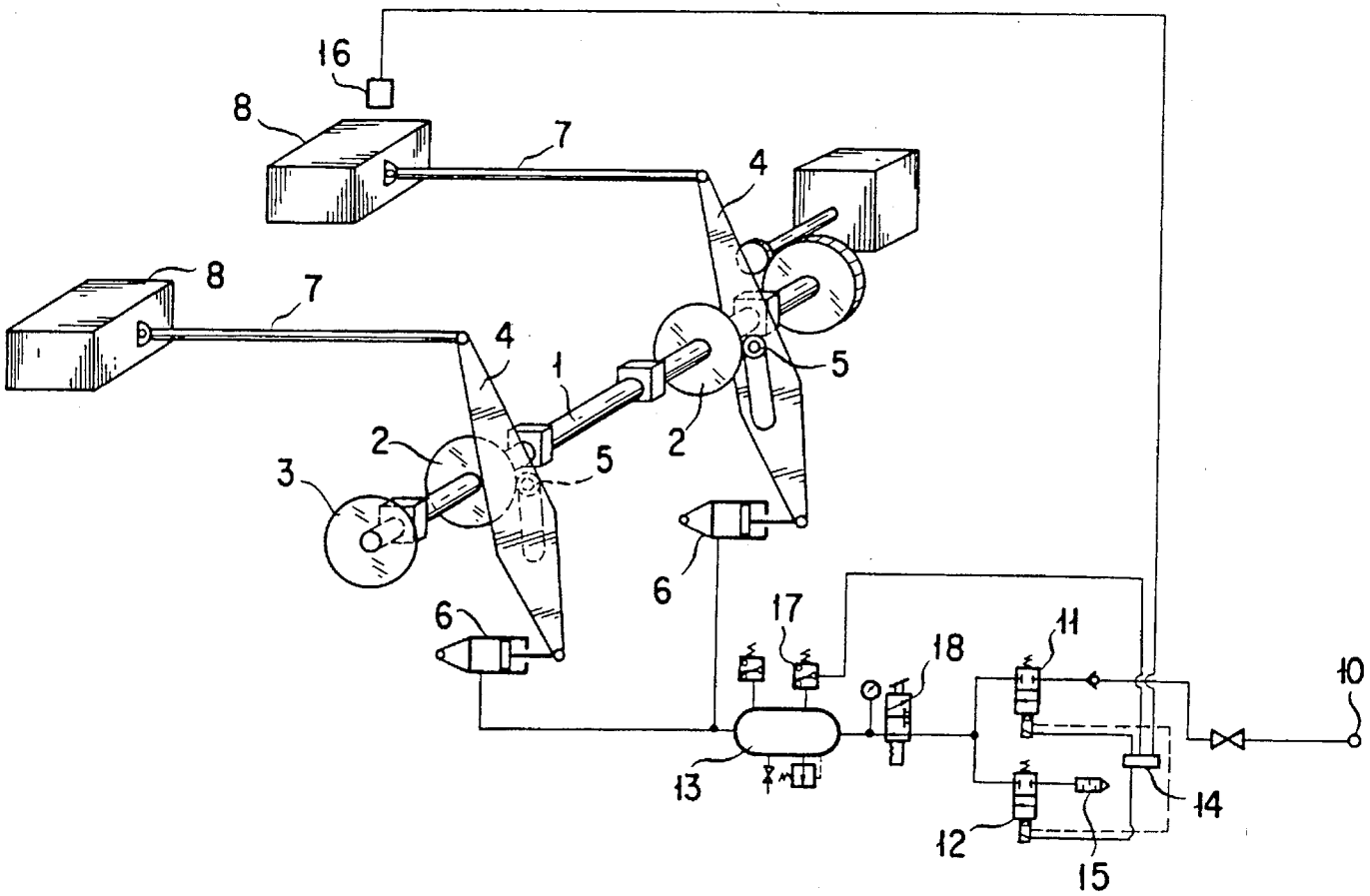
FIG. 1 is a circuit diagram showing one embodiment of a dynamic balancer circuit of a transfer feeder of the present invention.

FIG. 1 shows a driving system for a transfer feeder equipped for a transfer press, in which reference numeral 1 denotes a camshaft to be rotated by power taken out of a press.

Mounted to the camshaft 1 are a pair of feed cams 2 and a dummy cam 3, in which a feed lever 4 journaled at its lower end contacts a circumferential portion of each of these feed cams 2 through a cam follower 5.

Rear cushion cylinders 6 for pushing the cam followers 5 against outer peripheral surfaces of the feed cams 2 are provided at the lower ends of the feed levers 4, respectively, thereby swinging the respective feed levers 4 in accordance with the rotation of the camshaft 1, thus reciprocally driving transfer bars, not shown, in the feed direction through links and feed carriers, respectively.

In the meantime, there is provided a control circuit which comprises an air tank 13 connected to bottom sides of the rear cushion cylinders 6, an electromagnetic valve 11 connected between an air source 10 and the air tank 13, an electromagnetic valve 12 connected at one end to the air tank in parallel thereto and connected at the other end to a breather 15, a press speed detection sensor 16 disposed in the vicinity of the feed carrier 8 to detect a speed, that is, production speed of the press (press operation speed), a sequencer 14 acting to control the air pressure to the air tank 13 through an open-close control of the electromagnetic valves 11 and 12 in response to an input from the press speed detection sensor 16 on the basis of a program preliminarily set in accordance with a kind of work to be produced, and an air pressure sensor 17 for feeding back the detected air pressure in the air tank 13 to the sequencer 14. Further, reference numeral 18 denotes a manual air pressure supply-discharge valve. In the control circuit of the structure described above, the air pressure is supplied from the air source 10 to the rear cushion cylinders 6 through the electromagnetic valves 11, 12, the air pressure supply-discharge valve 18 and the air tank 13, and at the same time, the electromagnetic valves 11 and 12 are respectively subjected to the open-close control by the sequencer 14 in response to the production speed detected by the press speed detection sensor 16, thereby supplying the optimum air pressure to the rear cushion cylinders 6 in response to the production speed of the press.

Figure 2:
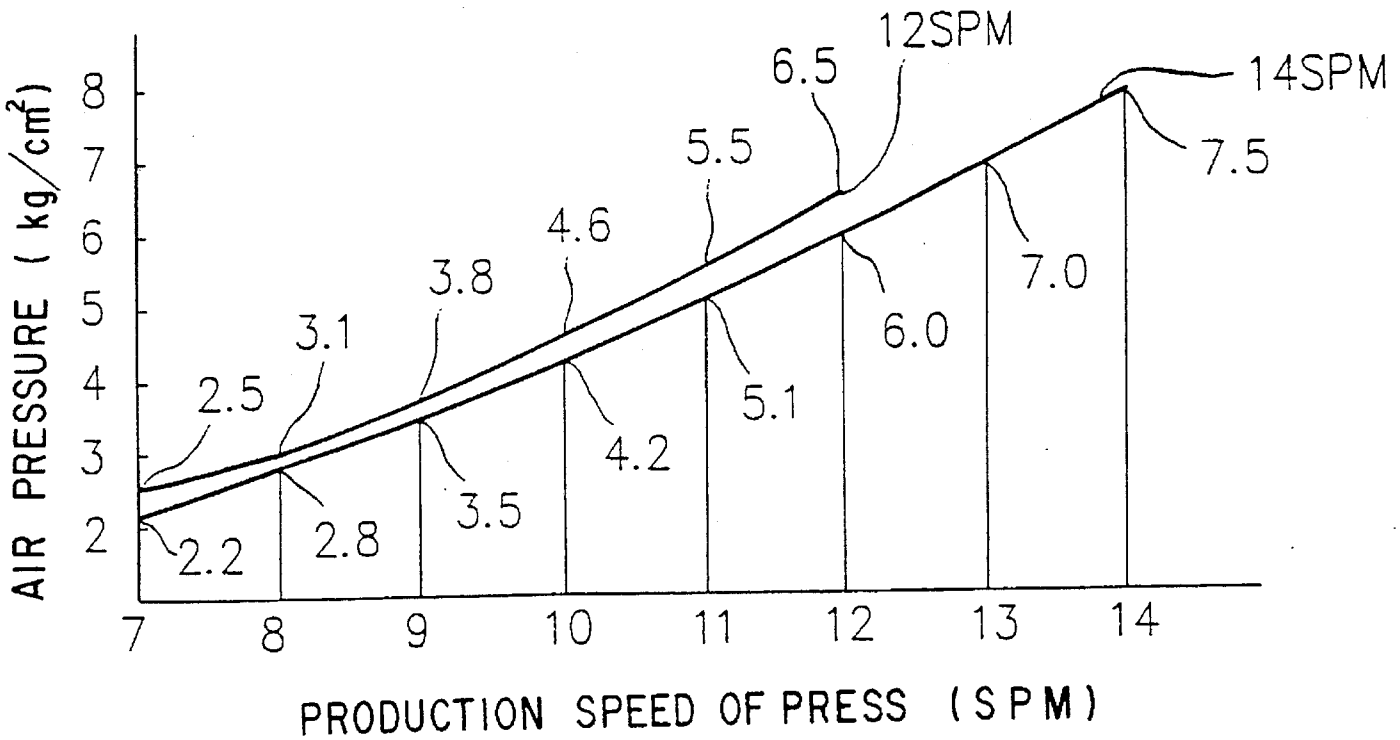
FIG. 2 is a diagram showing a relationship between a production speed of a press and an air pressure to be supplied to a rear cushion cylinder.

Further, the air pressure to be supplied to the rear cushion cylinders 6 is preliminarily set by means of the program so as to provide a relationship shown in FIG. 2 with respect to the production speed of the press (SPM).

The operation of the above embodiment will be described hereunder.

First, in the case of exchanging a mold, a program suitable for a work to be next produced is set in the sequencer 14.

Next, when the press starts to operate, the camshaft 1 is rotated by power taken out of the press, and the respective feed levers 4 are swung by the feed cams mounted to the camshaft 1, thereby carrying the work between the respective transfer bars.

At this time, the press speed detection sensor 16 detects the press production speed, which is inputted into the sequencer 14. The sequencer 14 then controls the opening and closing of the electromagnetic valves 11 and 12 in response to the inputted production speed, and the air pressure suitable for the production speed is supplied to the rear cushion cylinders 6 through the air tank 13.

Accordingly, during the operation of the transfer feeder, the cam followers 5 are pushed against the feed cams 2 by the rear cushion cylinders 6, respectively, with the minimum pushing force necessary, so that no torque other than what is necessary acts on the driving system including the feed cams 2 and the cam followers 5. Accordingly, the lifetime of the driving system can be improved and the power consumption can be reduced.

Further, the pushing force F of the cam follower 5 with respect to the press operating speed will be calculated in the following manner.

Figure 3:
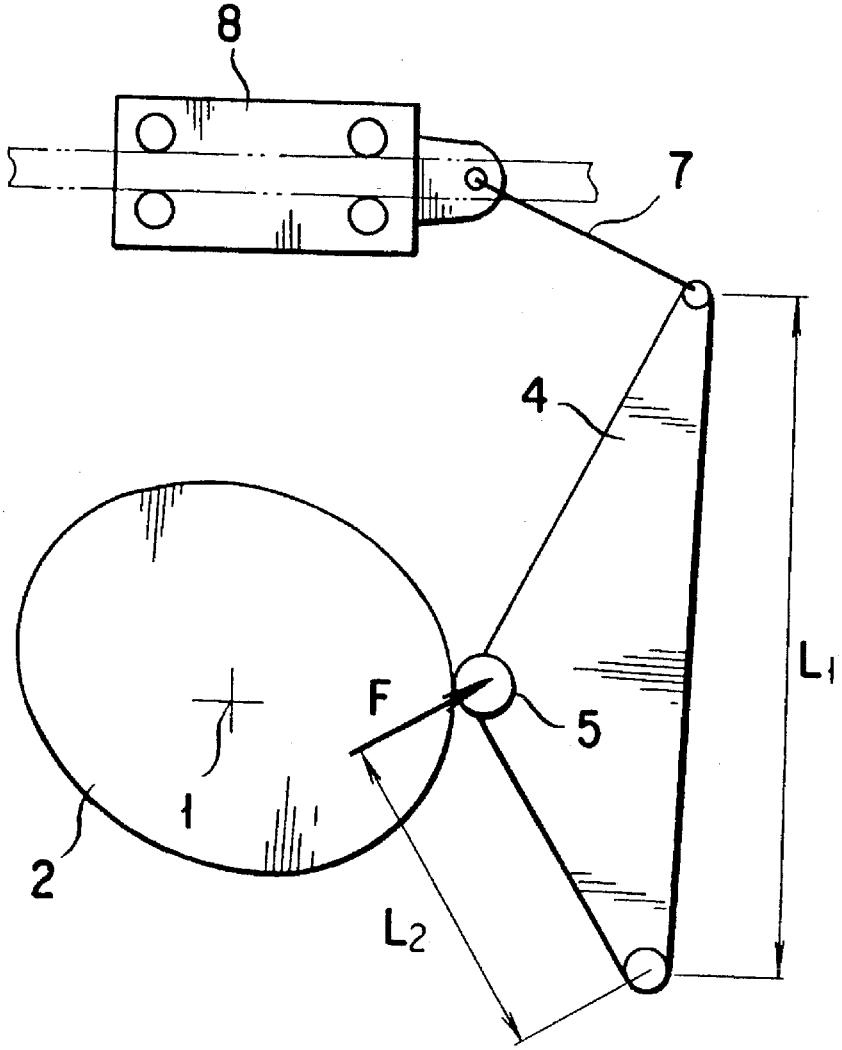
FIG. 3 is a view for the explanation of calculation of a pushing force of a cam follower of a feed lever with respect to a feed cam.

Now, supposing that an inertia force on the side of the transfer bar is set to $m\alpha$, a friction force is set to f, and a dimension of the transfer lever 4 is set to that shown in FIG. 3, the following relations will be established.

$$F=r\times(m\alpha+f)$$

$$r=L_1/L_2$$

$$\alpha=S/t_h^2\times C$$

$$t_h=60\times\theta/(N\times 360)$$

wherein C: constant; S: stroke; $t_h^2$: operating time; and N: SPM.

Accordingly, the air pressure to be supplied to the rear cushion cylinders 6 may be set so as to generate the pushing force F calculated in accordance with the above manner.

Further, in the above embodiment, although the set pressure of the rear cushion cylinders provided for the feed levers 4 is made variable, a set pressure of the rear cushion cylinder 6 pushing the follower cam 5 against the dummy cam 3 may be made variable.

Further, in the above, although the preferred embodiment of the present invention is described, with respect to the described embodiment, it is to be noted that various modifications, eliminations and additions may be acceptable by persons skilled in the art within the subject and scope of the present invention. Accordingly, the present invention is not limited to the described embodiment and includes the scope defined by elements recited in claims and equivalency thereof.

POSSIBILITY OF INDUSTRIAL USAGE

As described above, the dynamic balancer circuit of a transfer feeder according to the present invention is extremely useful for the improvement of lifetime of the transfer feeder equipped for a transfer press and for the reduction of the power consumption.

We claim:

1. In a transfer feeder used in a transfer press, which transfer feeder includes a transfer bar, a feed lever which drives the transfer bar in a feeding direction by swinging movement of the feed lever, a cam follower connected with the feed lever, a camshaft rotated by power taken out of a transfer press, operable at a production speed, and a feed cam mounted to the camshaft to be in contact with the cam follower for controlling swinging movement of the feed lever, a dynamic balancer circuit comprising:

a rear cushion cylinder coupled to the feed lever to produce a force on the feed lever for urging the cam follower into contact with the feed cam; and a control circuit operatively connected to the rear cushion cylinder for controlling pressure in said rear cushion cylinder to set the force on the feed lever in response to the production speed of the transfer press.

2. A dynamic balancer circuit of a transfer feeder according to claim 1, wherein said force is a minimum force needed at the production speed of the transfer press for swinging the feed lever.

3. A dynamic balancer circuit of a transfer feeder according to claim 1, wherein said control circuit controls said pressure so as to generate the force in relation to the production speed of the transfer press, a dimension of the feed lever, and a stroke of the feed lever.

4. A dynamic balancer circuit of a transfer feeder according to claim 1, wherein the pressure in said rear cushion cylinder is air pressure.

5. A dynamic balancer circuit of a transfer feeder according to claim 1, wherein the force produced by the rear cushion cylinder is a pushing force.

6. A dynamic balancer circuit of a transfer feeder according to claim 1, wherein said control circuit comprises:

a press speed detection sensor for detecting the production speed of the transfer press, an electromagnetic valve unit disposed between an air supply source and the rear cushion cylinder, and a sequencer for controlling the electromagnetic valve unit in response to the production speed of the press detected by the press speed detection sensor on the basis of a preset program set in accordance with a kind of a work to be performed by the transfer feeder.

7. A dynamic balancer circuit of a transfer feeder according to claim 6, wherein said control circuit further comprises:

an air pressure detection sensor for detecting air pressure to be supplied to the rear cushion cylinder and the detected air pressure value is fed back to the sequencer.

8. A dynamic balancer circuit of a transfer feeder according to claim 3, wherein said control circuit sets a minimum for said force between the feed cam and the cam follower for swinging the feed lever.

9. In a transfer feeder used in a transfer press, which transfer feeder includes a transfer bar, a feed lever which drives the transfer bar in a feeding direction by swinging movement of the feed lever, a cam follower connected with the feed lever, a camshaft rotated by power taken out of a transfer press operable at a production speed, and a feed cam mounted to the camshaft to be in contact with the cam follower for controlling swinging movement of the feed lever, a dynamic balancer circuit comprising:

a rear cushion cylinder mounted on the feed lever to produce a force on the feed lever for urging the cam follower into contact with the feed cam; and a control circuit operatively connected to the rear cushion cylinder for controlling pressure in said rear cushion cylinder to set a minimum force needed at the production speed of the transfer press for swinging the feed lever.

10. A dynamic balancer circuit according to claim 9, wherein said control circuit controls said pressure so as to generate the force in relation to the production speed of the transfer press, a dimension of the feed lever, and a stroke of the feed lever.

11. A dynamic balancer circuit of a transfer feeder according to claim 9, wherein said control circuit comprises:

a press speed detection sensor for detecting the production speed of the transfer press, an electromagnetic valve unit disposed between an air supply source and the rear cushion cylinder, and a sequencer for controlling the electromagnetic valve unit in response to the production speed of the press detected by the press speed detection sensor on the basis of a preset program set in accordance with a kind of a work to be performed by the transfer feeder.

12. A dynamic balancer circuit of a transfer feeder according to claim 11, wherein said control circuit further comprises:

an air pressure detection sensor for detecting air pressure to be supplied to the rear cushion cylinder and the detected air pressure value is fed back to the sequencer.

13. A dynamic balancer circuit of a transfer feeder according to claim 9, wherein the pressure in said rear cushion cylinder is air pressure.

14. A dynamic balancer circuit of a transfer feeder according to claim 9, wherein the force produced by the rear cushion cylinder is a pushing force.

15. A dynamic balancer circuit of a transfer feeder according to claim 9, wherein the minimum pushing force set by said control circuit produces a minimum force between the feed cam and the cam follower for swinging the feed lever.

* * * * *